US010145642B1

(12) United States Patent
Darlington et al.

(10) Patent No.: US 10,145,642 B1
(45) Date of Patent: Dec. 4, 2018

(54) ARCHERY BOW

(71) Applicant: Rex F. Darlington, Whitemore, MI (US)

(72) Inventors: Rex F. Darlington, Whitemore, MI (US); David P. McNeil, II, Howard City, MI (US)

( * ) Notice: Subject to any disclaimer, the term of this patent is extended or adjusted under 35 U.S.C. 154(b) by 0 days.

(21) Appl. No.: 15/659,189

(22) Filed: Jul. 25, 2017

Related U.S. Application Data

(60) Provisional application No. 62/367,308, filed on Jul. 27, 2016.

(51) Int. Cl.
*F41B 5/10* (2006.01)
*F41B 5/12* (2006.01)
*F41B 5/14* (2006.01)

(52) U.S. Cl.
CPC ..... *F41B 5/123* (2013.01); *F41B 5/10* (2013.01); *F41B 5/12* (2013.01); *F41B 5/14* (2013.01)

(58) Field of Classification Search
CPC .. F41B 5/00; F41B 5/0094; F41B 5/10; F41B 5/12; F41B 5/14
See application file for complete search history.

(56) References Cited

U.S. PATENT DOCUMENTS 3,981,290 A 9/1976 Islas
4,287,867 A 9/1981 Islas
5,388,564 A * 2/1995 Islas ..... F41B 5/0094 124/23.1
5,499,618 A * 3/1996 Thompson ..... F41B 5/0094 124/25.6
5,967,132 A 10/1999 Loomis
5,979,425 A 11/1999 Loomis
6,067,974 A * 5/2000 Islas ..... F41B 5/0094 124/25.6
8,826,894 B1 9/2014 Darlington et al.

OTHER PUBLICATIONS www.monsterbows.com, "Introducing the 2007 Phoenix by Monster Bows".

* cited by examiner

*Primary Examiner* — John Ricci
(74) *Attorney, Agent, or Firm* — Reising Ethington, P.C.

(57) ABSTRACT

An archery bow comprises first and second limb levers pivotably coupled to first and second limbs about first and second lever pivot axes. The levers include intermediate sections between forward and rearward sections on forward and rearward sides of the pivot axes. A bowstring is coupled to the rearward sections, a first cable is coupled to the forward section and to the intermediate section of the second limb lever, and a second cable is coupled to the forward section and to the intermediate section of the first limb lever. One or both of the cables is coupled to its respective limb lever in a central plane perpendicular to and centered across the respective pivot axis, and/or is coupled to the intermediate section of the other limb lever in a location such that the first cable is intersectable with the other lever pivot axis.

28 Claims, 10 Drawing Sheets

ARCHERY BOW

TECHNICAL FIELD

This disclosure relates generally to archery bows and, more particularly, to compound archery bows including compound vertical bows and compound crossbows.

BACKGROUND

Archery bows fundamentally include a riser having opposite ends and a handle therebetween, flexible limbs extending from the ends of the riser and having free ends, and a bowstring coupled to the free ends of the limbs. One type of compound archery bow typically also includes eccentric cams at the ends of the limbs. The bowstring is typically coupled to the cams around an outer circumference thereof, and power cables are typically coupled around other circumferential portions of the cams to control bowstring draw characteristics. Another type of compound archery bow includes levers coupled to the ends of the limbs and having rearward ends to which the bowstring is coupled, and forward ends and midsections to which power cables are coupled to control bowstring draw characteristics.

BRIEF DESCRIPTION OF THE DRAWINGS

FIG. 9*a* is an enlarged fragmentary view of the bow of FIG. 9, taken from the circle of FIG. 9;

DETAILED DESCRIPTION

Figure 1:
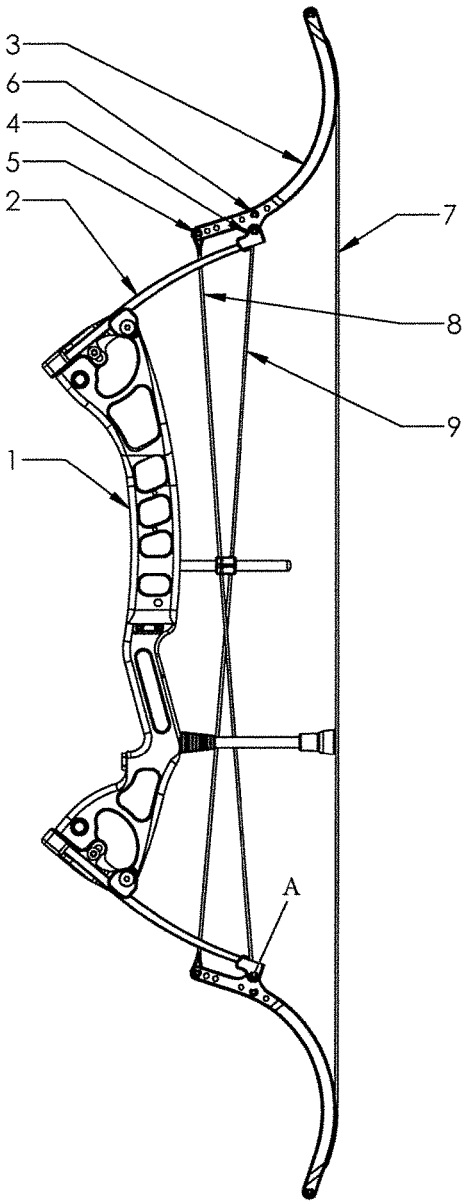
FIG. 1 is a side view according to an illustrative embodiment of an archery bow in a state of rest.
Figure 2:
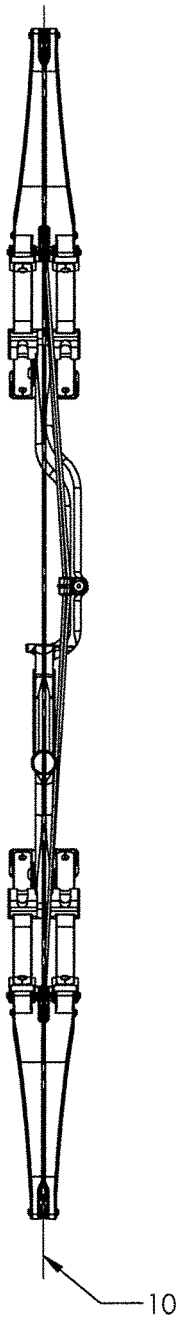
FIG. 2 is a rear view of the archery bow of FIG. 1.

In general, an archery bow will be described using one or more examples of illustrative embodiments of a vertical compound bow. However, it will be appreciated as the description proceeds that the inventive subject matter may be embodied in a crossbow.

Referring specifically to the drawings, FIGS. 1-4*a* illustrate an illustrative embodiment of a vertical compound bow including a riser 1 generally at a front of the bow, upper and lower or first and second limbs 2 extending from the riser 1, upper and lower or first and second limb levers 3 pivotably coupled to the respective limbs 2, and hinges 4 having lever pivot axes and pivotably coupling the limb levers 3 to the limbs 2. The lever pivot axes may be split axes such that a cable may extend or pass between portions of the levers, for example, bifurcations of the lever. The bow also includes a bowstring 7 generally at a rear of the bow and coupled to the limb levers 3, and first and second cables 8, 9 coupled between the first and second limb levers 3. The bow further includes a cable guide extending in a rearward direction from a fixed end at the riser toward a free end, and a cable slide carried by the cable guide and carrying the cables.

The bow need not include rotary cams and/or independent timing features. Independent timing has been used with conventional lever limb bow designs to keep both independent levers/ends of the bow moving at the same time.

The riser 1 is also known as a bow body or block and includes opposite ends that may be coupled to the limbs 2, and a handle between the ends for gripping by an archer. In a crossbow embodiment, a stock may be coupled to the riser 1 in any suitable manner.

The limbs 2 may be coupled to the riser 1 by integral connection, separate fasteners, or in any other suitable manner. The first and second limbs 2 may include split limbs and the first and second cables may extend between the split first and second limbs. More specifically, the limbs 2 may be bifurcated or split to define a longitudinally extending space between limb portions. For instance, each of the limbs 2 may include a single forked component or two components spaced apart and extending longitudinally side by side. The limbs 2 may include flexible beams cantilevered from the riser 1 at fixed ends and extending to lever ends for coupling to the levers 3. The limbs 2 may include only beams themselves or may include additional hardware to facilitate coupling to the riser 1 and/or the levers 3. For example, the hardware may include bracketry, fasteners, welds, or any other suitable expedients for coupling to the riser 1 and/or the levers 3.

The limb levers 3 may include fulcrums at the pivot axes A, forward sections on forward sides of the pivot axes, rearward sections on rearward sides of the pivot axes, and intermediate sections between the forward and rearward sections. The forward sections may include cable take-up portions, and the intermediate sections may include cable let-out and/or take-up portions. 0% let-off can be achieved when both the forward and intermediate sections take up cable. In one embodiment, good results may be achieved when the intermediate sections take up cable in the beginning of draw and then toward the end of draw the intermediate sections let out cable. Also, the intermediate section also can be configured only to let out cable. The limb levers 3 may be bifurcated to include laterally spaced apart bifurcations such that the cables may extend into spaces between the bifurcations. In the illustrated embodiment, the limb levers 3 include unitary forked components with upper or outward ends from which two side by side bifurcations extend downwardly or inwardly. Although shown as curved, the limb levers could instead be straight.

The hinges 4 include the pivot axes A that act as fulcrums for the limb levers 3 and about which the limb levers 3 pivot with respect to the limbs 2. The hinges 4 may include only integral portions of the limbs 2 and levers 3, or portions of the limbs 2 and levers 3 and a hinge shaft extending therethrough, bracketry and a hinge shaft, or any other hinge structure suitable to effect pivoting of the levers 3 relative to the limbs 2. The hinge shaft may include one or more integral portions of one or both of the limbs 2 and/or levers 3, a pin, a rod, or any other suitable hinge member.

The bowstring 7 is coupled to the rearward sections of the limb levers. The bowstring 7 is also known as a bowstring cable and, in any event, is configured for pulling by an archer to draw the bow. The bowstring 7 may include loops pivotably anchored around anchors on the rearward sections of the limb levers. More specifically, the anchors may be cylindrical, for instance shafts pivotably coupled to the limb levers. In other embodiments, the anchors may include one or more integral portions of the limb levers, or any other suitable anchor members. The anchors may have pivot axes parallel to the hinge axes.

The first cable 8 is coupled to the forward sections of the first limb lever and is coupled to the intermediate section of the second limb lever in a location such that the first cable is intersectable with the second lever pivot axis. More specifically, the first cable may be coupled to the intermediate section of the second limb lever in a location such that the first cable intersects the second lever pivot axis when the archery bow is in a state of rest. Also, the first cable may be coupled to the intermediate section of the second limb lever in a location such that the first cable is traversable through the second lever pivot axis. For example, the first cable may be coupled to the intermediate section of the second limb lever in a location such that the first cable traverses the second lever pivot axis as the archery bow is drawn. More specifically, the first cable may be coupled to the intermediate section of the second limb lever in a location such that the first cable is disposed rearward of the second lever pivot axis when the archery bow is fully drawn.

Likewise, the second cable 8 is coupled to the forward sections of the second limb lever and coupled to the intermediate section of the first limb lever in a location such that the second cable is intersectable with the first lever pivot axis. More specifically, the second cable may be coupled to the intermediate section of the first limb lever in a location such that the second cable intersects the first lever pivot axis when the archery bow is in a state of rest. Also, the second cable is coupled to the intermediate section of the first limb lever in a location such that the second cable is traversable through the first lever pivot axis. For example, the second cable may be coupled to the intermediate section of the first limb lever in the location such that the second cable traverses the first lever pivot axis as the archery bow is drawn. More specifically, the second cable may be coupled to the intermediate section of the first limb lever in a location such that the second cable is disposed rearward of the first lever pivot axis when the archery bow is fully drawn.

Figure 3:
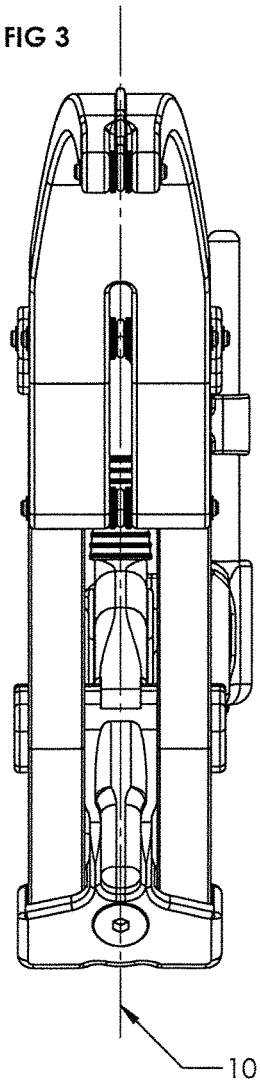
FIG. 3 is an enlarged, top view of the archery bow of FIG. 1.

With respect to FIG. 3, at least one of the first cable or the second cable may be coupled to the respective limb lever in a central plane 10 perpendicular to the respective pivot axis. The central plane 10 may be centered across the pivot axis, for example, centered between opposite lateral outboard ends of the hinge 4.

At least one of the first cable or the second cable may include a loop pivotably anchored around an anchor on the respective limb lever 3. More specifically, the anchor may be cylindrical, for instance a shaft pivotably coupled to the respective limb lever. In other embodiments, the anchor may include one or more integral portions of one or both of the limbs 2 and/or levers 3, or any other suitable anchor member. The anchors may have pivot axes parallel to the hinge axes. The cable anchors at the forward sections of the levers 3 may be disposed inboard of the hinge axes, whereas the cable anchors at the intermediate sections of the levers 3 may be disposed outboard of the hinge axes, as illustrated.

Anchors 5 at the forward sections of the levers 3 may be termed "take-up anchors", and anchors 6 at the intermediate sections of the levers 3 may be termed "let-out anchors" (and/or "take-up anchors" when the intermediate sections take up cable in the beginning of draw and then toward the end of draw the intermediate sections let out cable). The forward anchors 5 may be selectively adjusted among a plurality of anchor locations, for instance, forward-most anchor locations proximate forward ends of the levers, intermediate anchor locations spaced rearwardly of the forward-most anchor location, and rearward anchor locations spaced rearwardly of the intermediate anchor locations, as illustrated. Likewise, the intermediate anchors 6 may include a plurality of anchor locations, for instance forward, intermediate, and rearward anchor locations, as illustrated. The forward anchor location may be forward of the pivot axis, the rearward anchor location may be rearward of the pivot axis, and the intermediate anchor location may be centrally aligned with the pivot axis along a common plane. The anchors 5, 6 may be split axle anchors, in that axles may be carried through spaced apart portions, e.g. bifurcations, of the levers, and the cables 8, 9 may be coupled to the anchors between the spaced apart portions of the levers.

Figure 4:
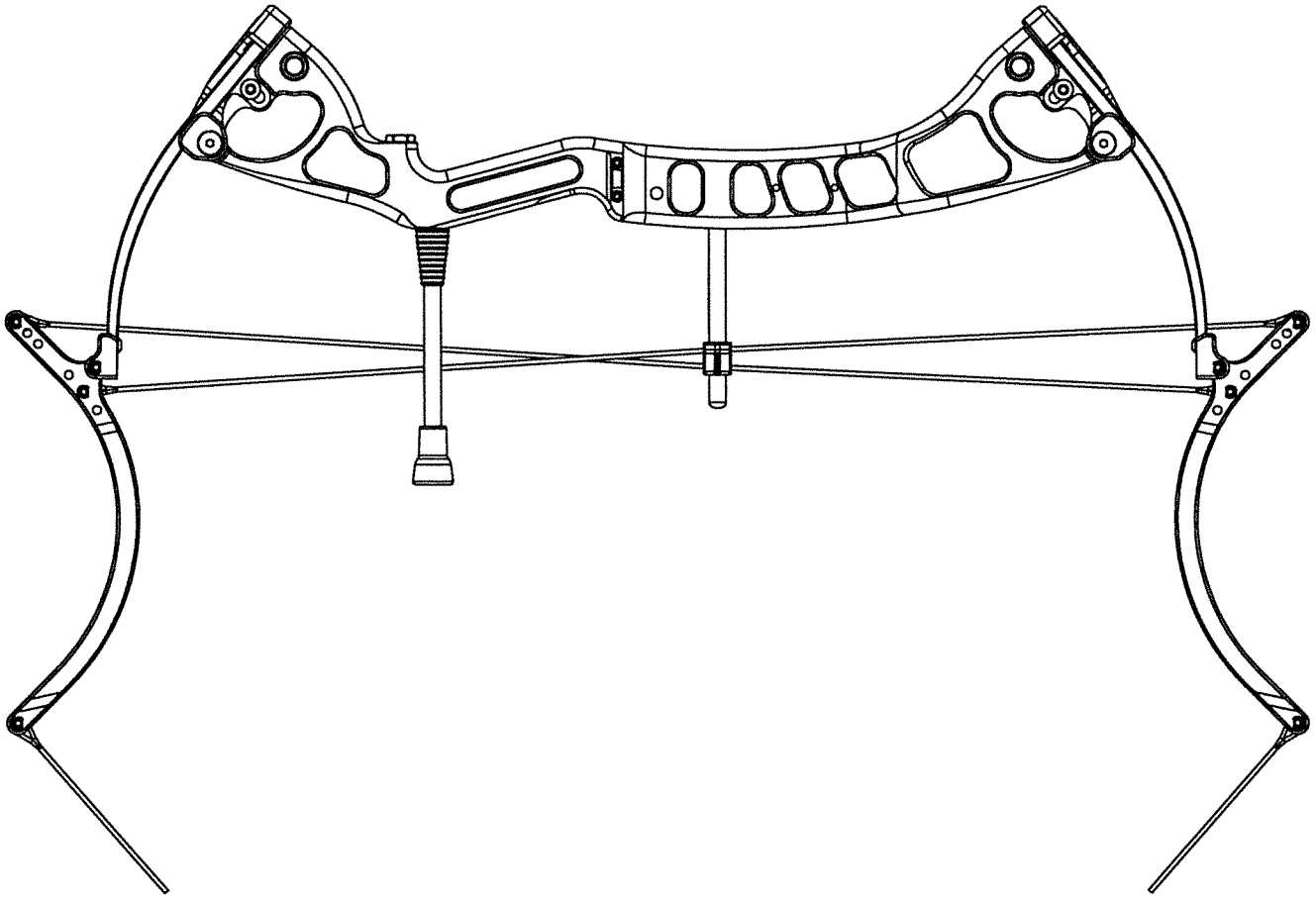
FIG. 4 is a side view of the archery bow of FIG. 1 in a drawn state.
Figure 4A:
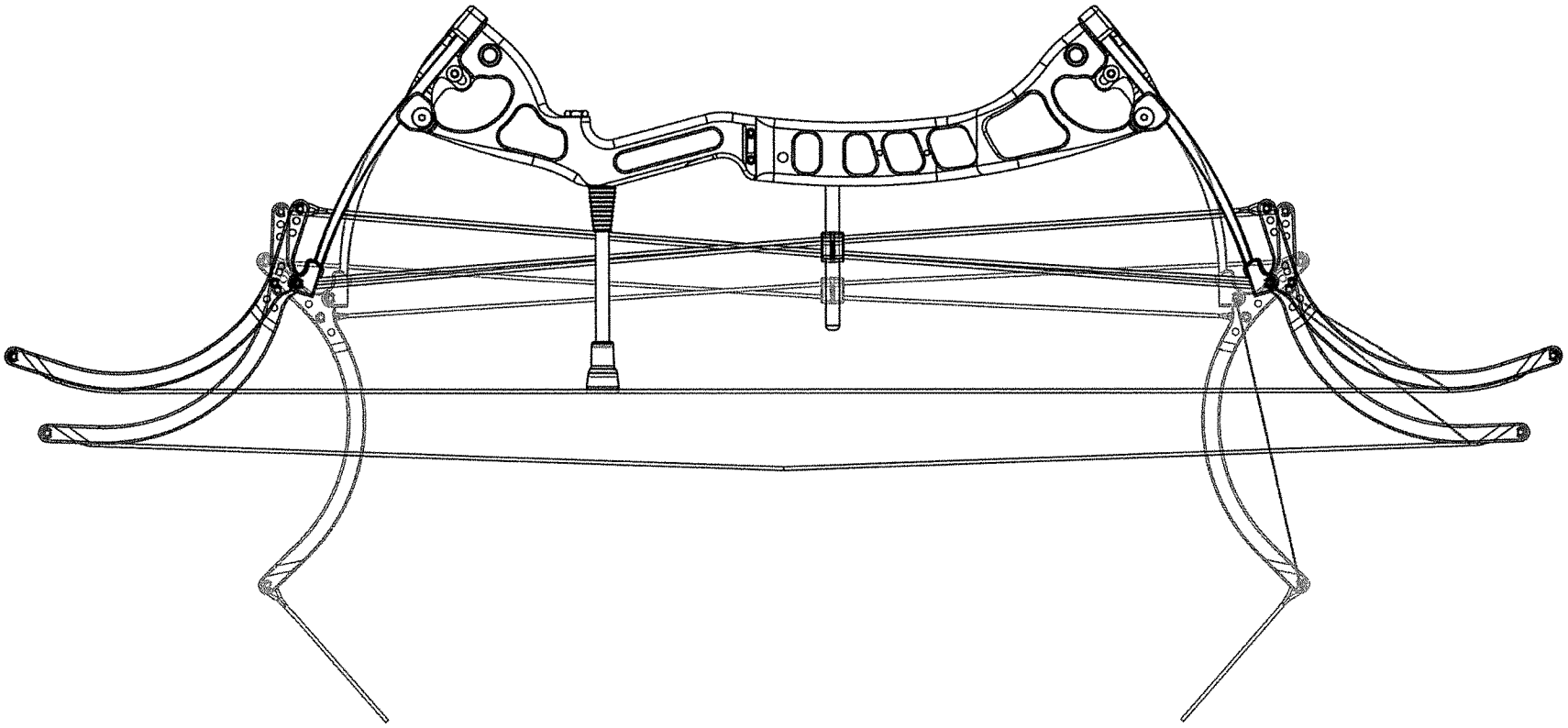
FIG. 4*a* is a side view of the archery bow of FIG. 1, illustrating variable bowstring to limb lever length.
Figure 5:
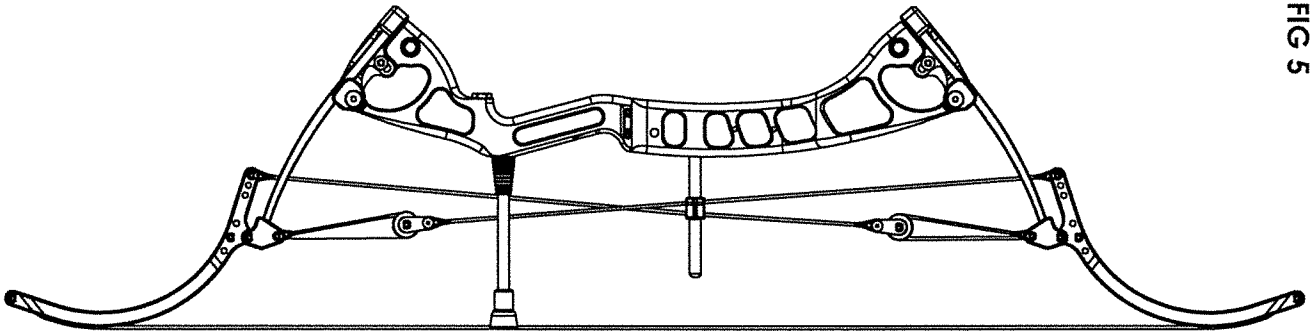
FIG. 5 is a side view according to another illustrative embodiment of an archery bow in a state of rest.
Figure 6:
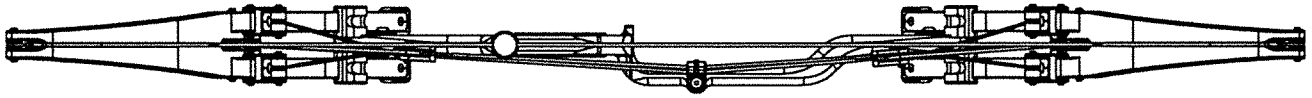
FIG. 6 is a rear view of the archery bow of FIG. 5.
Figures 7, 7A:
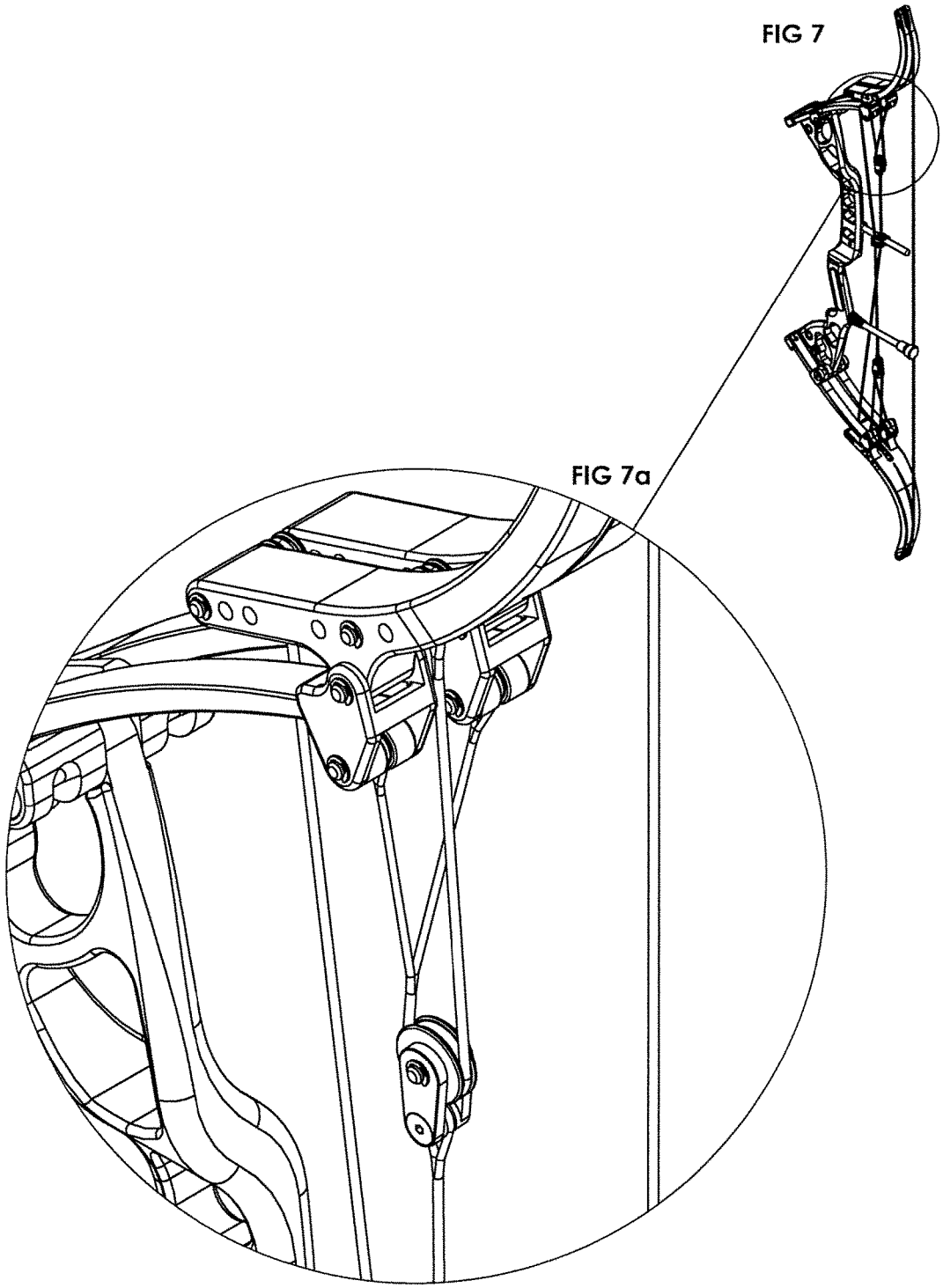
FIG. 7 is a reduced, upper, rear, perspective view of the archery bow of FIG. 5.
FIG. 7*a* is an enlarged, fragmentary view of a portion of the archery bow of FIG. 7 taken from circle 7*a* of FIG. 7.
Figure 8:
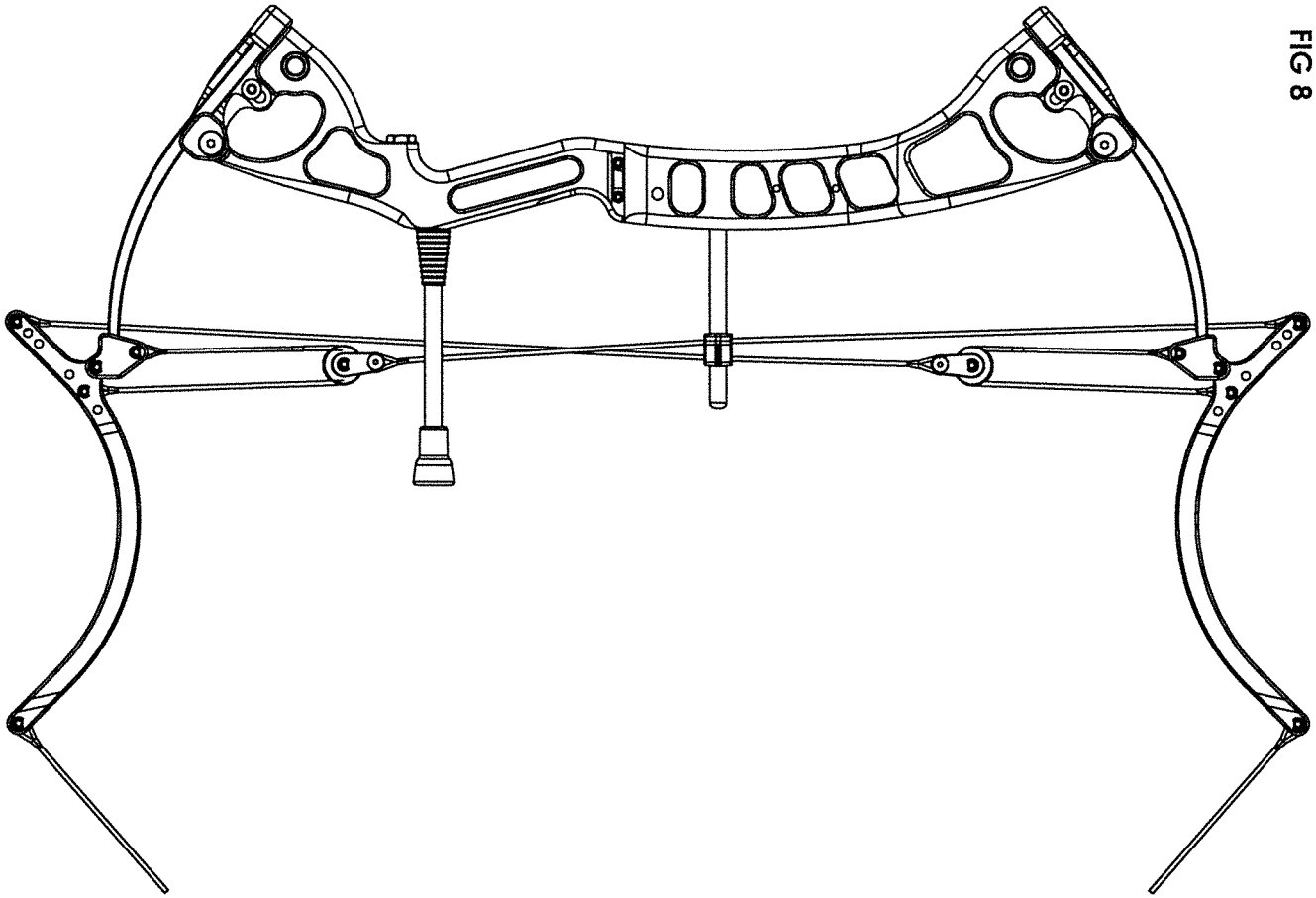
FIG. 8 is a side view of the archery bow of FIG. 5 in a drawn state.

As shown in FIG. 4*a*, in a state of rest, the bowstring contacts excurvate rear surfaces of the limb levers at first tangent points. Then, as also shown in FIG. 4*a*, as the bowstring is drawn back from the state of rest, the bowstring contacts the rear surfaces of the limb levers at second tangent points, and so on according to progressively distant tangent points, until the bowstring disengages from tangential contact with the excurvate rear surfaces of the limb levers. Accordingly, the bow provides variable leverage as the bowstring is drawn back. In any event, during a draw cycle as the bowstring is pulled rearwardly, the distances from the bowstring to limb lever contact points to the lever pivot axes are not constant, such that the bow has variable leverage during the draw cycle.

FIGS. 5-8 illustrate another illustrative embodiment of an archery bow. This embodiment is similar in many respects to the embodiment of FIGS. 1-4. The descriptions of the embodiments are hereby incorporated into one another, and description of subject matter common to the embodiments generally may not be repeated.

A first cable is coupled to the forward sections of the first limb lever and is coupled to the intermediate section of the second limb lever in a location such that the first cable is intersectable with the second lever pivot axis. The first cable includes a first yoke pulley having a first yoke body and a first yoke roller rotatably coupled to the first yoke body. The first cable also includes a first yoke roller cable including a first roller cable portion coupled to the second limb lever and a first split roller cable portion coupled to the second limb. The first cable further includes a first yoke body cable coupled to the first yoke body and to the first limb lever.

A second cable is coupled to the forward sections of the second limb lever and coupled to the intermediate section of the first limb lever in a location such that the second cable is intersectable with the first lever pivot axis. The second cable includes a second yoke pulley having a second yoke body and a second yoke roller rotatably coupled to the second yoke body. The second cable also includes a second yoke roller cable including a second roller cable portion coupled to the first limb lever and a second split roller cable portion coupled to the first limb. The second cable further includes a second yoke body cable coupled to the second yoke body and to the second limb lever.

At least one of the first split roller cable portion or the second split roller cable portion may include loops pivotably anchored around axially spaced apart anchors on the respective limb, for instance, on mounting brackets coupled to the limb beams, as illustrated. More specifically, the anchors may be cylindrical, for instance one or more shafts pivotably coupled to the respective limb portion. In other embodiments, the anchors may include one or more integral portions of one or both of the limbs, or any other suitable anchor member(s). The anchors may have pivot axes parallel to the hinge axes. The split roller cable anchors may be disposed below or inboard of the hinge axes, as illustrated.

Figure 9:
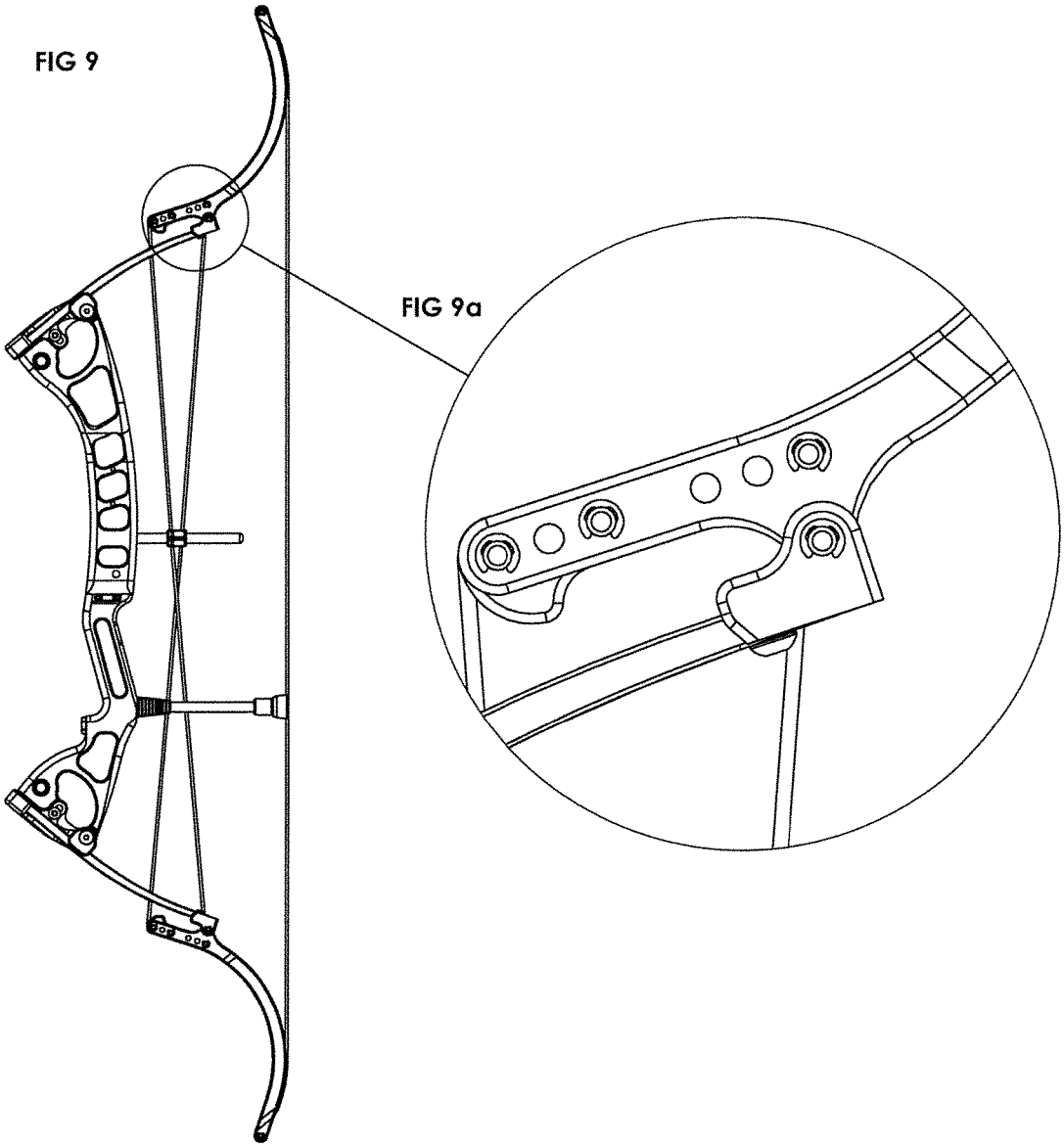
FIG. 9 is a side view according to another illustrative embodiment of an archery bow in a state of rest.
Figure 10:
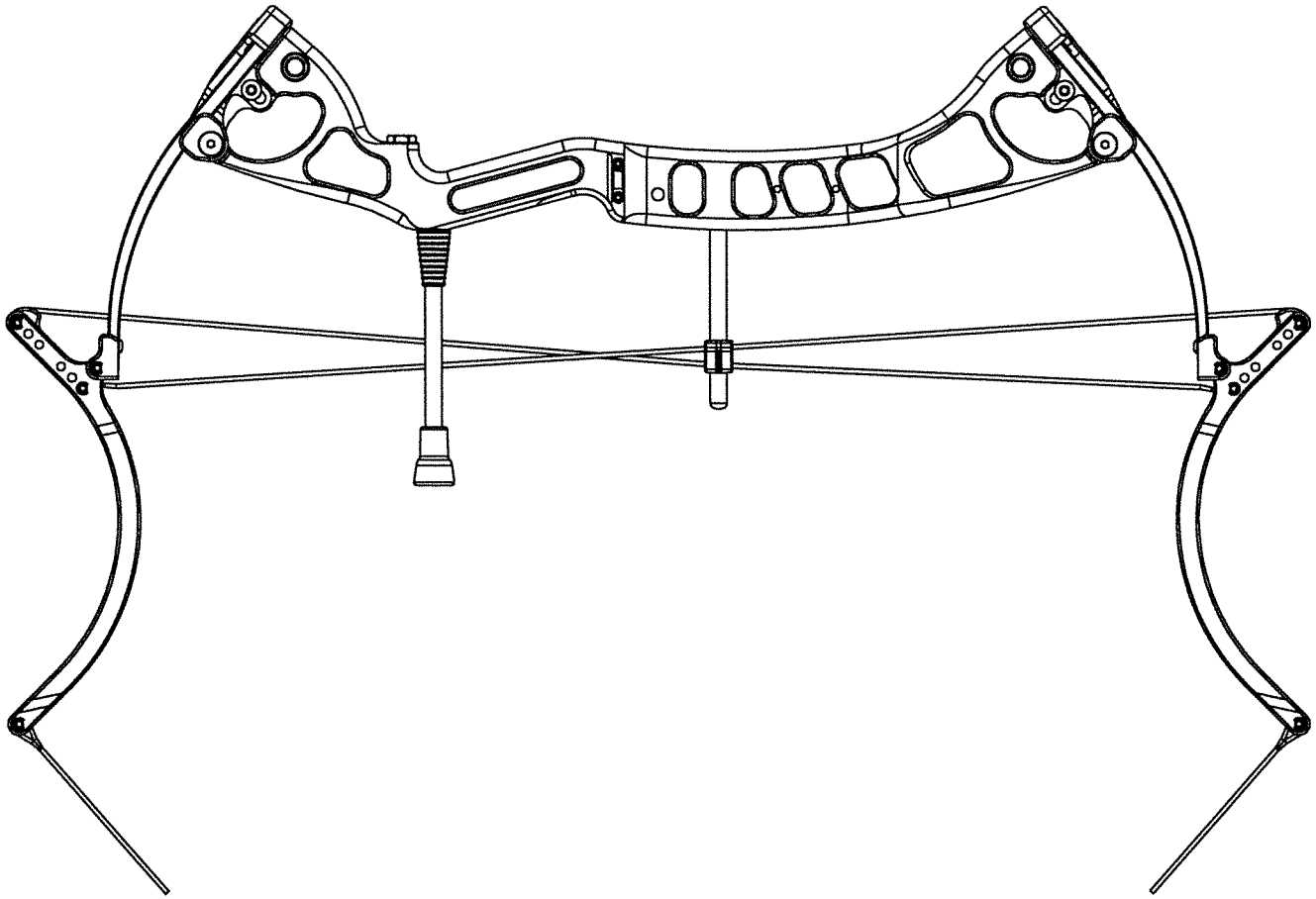
FIG. 10 is a side view of the archery bow of FIG. 9 in a drawn state.

FIGS. 9-10 illustrate another illustrative embodiment of an archery bow. This embodiment is similar in many respects to the embodiments of FIGS. 1-8. The descriptions of the embodiments are hereby incorporated into one another, and description of subject matter common to the embodiments generally may not be repeated.

This embodiment is similar to that illustrated in FIGS. 1-4, except that a take-up cam is carried at the take-up anchor location to provide an eccentric take-up track such that additional tension may be applied to the corresponding take-up portion of the corresponding cable. The cam may be fixed with respect to the limb lever. The cam may include a continuous track as illustrated, but may also include a series of discrete posts, or any other suitable arrangement to produce an eccentric path for a cable. Also, all intermediate anchor locations may be located forward of the pivot axis.

Figure 11A:
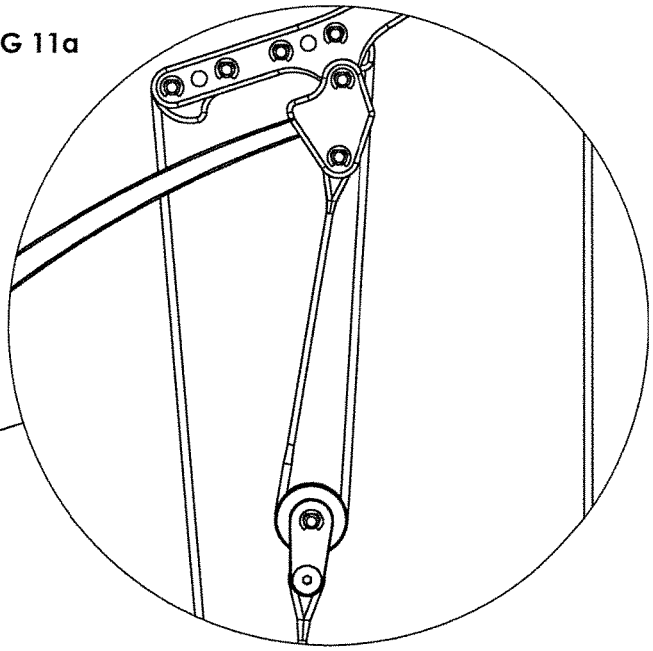
FIG. 11*a* is an enlarged fragmentary view of the bow of FIG. 11, taken from the circle of FIG. 11.
Figure 11:
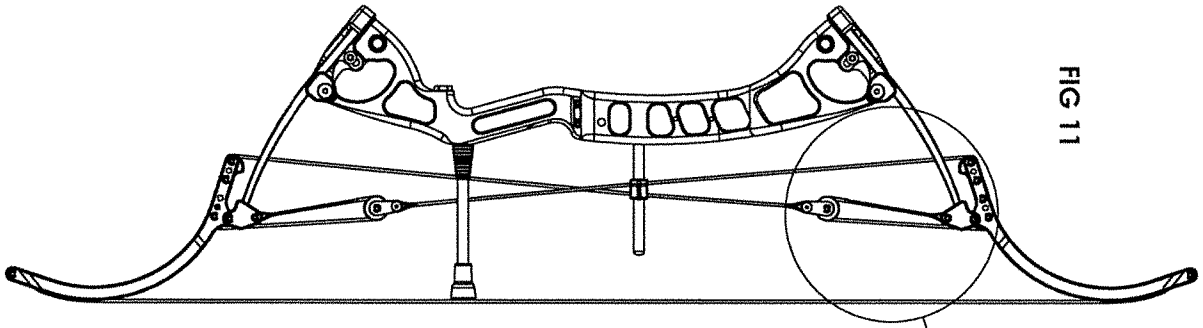
FIG. 11 is a side view according to another illustrative embodiment of an archery bow in a state of rest.
Figure 11B:
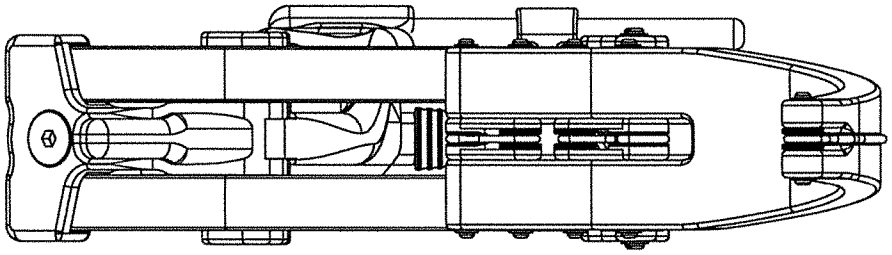
FIG. 11*b* is an enlarged, top view of the archery bow of FIG. 11.
Figure 12:
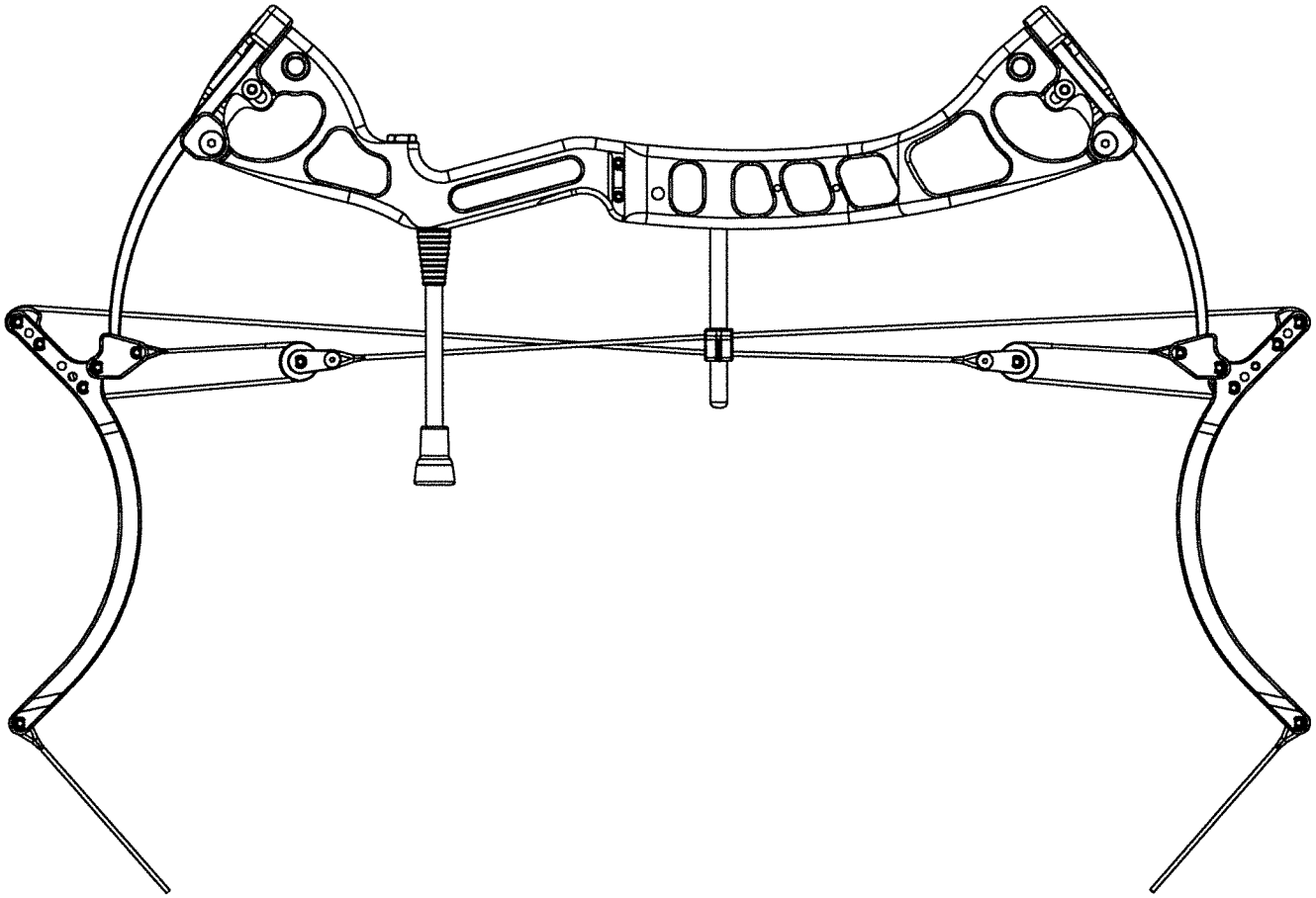
FIG. 12 is a side view of the archery bow of FIG. 11 in a drawn state.

FIGS. 11-12 illustrate another illustrative embodiment of an archery bow. This embodiment is similar in many respects to the embodiments of FIGS. 1-10. The descriptions of the embodiments are hereby incorporated into one another, and description of subject matter common to the embodiments generally may not be repeated.

This embodiment is similar to that illustrated in FIGS. 5-8, except that a take-up cam is carried at a location forward of the take-up anchor location such that the corresponding cable extends over the take-up cam to provide an eccentric take-up track such that additional tension may be applied to the corresponding take-up portion of the cable. Similarly, a cam is carried at a location rearward of the intermediate anchor location such that the corresponding cable extends over the cam to provide an eccentric track for the corresponding portion of the corresponding cable.

Also, a let-out (and/or take-up) cam is carried at the let-out (and/or take-up) anchor location to provide an eccentric let-out (and/or take-up) track such that a corresponding cable may be carried on an eccentric path. The let-out (and/or take-up) cam may be fixed with respect to the limb lever. The cam may include a continuous track as illustrated, but may also include a series of discrete posts, or any other suitable arrangement to produce an eccentric path for a cable.

In general, the components of the bow can be manufactured according to techniques known to those skilled in the art, including molding, machining, stamping, drawing, and other bow component manufacturing techniques. Also, the bow can be assembled according to known techniques, manual and/or automatic. Likewise, any suitable materials can be used in making the components, such as metals, composites, polymeric materials, and other bow component materials.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Therefore, the claimed invention is not limited to the particular examples of illustrative embodiments disclosed herein but, instead, is defined by the accompanying claims.

The invention claimed is:

1. An archery bow, comprising:

first and second limbs;

first and second limb levers pivotably coupled to the first and second limbs about first and second lever pivot axes and including:

forward sections on forward sides of the pivot axes, rearward sections on rearward sides of the pivot axes, and intermediate sections between the forward and rearward sections;

a bowstring coupled to the rearward sections of the limb levers;

a first cable coupled to the forward section of the first limb lever and coupled to the intermediate section of the second limb lever in a location such that the first cable is intersectable with the second lever pivot axis; and a second cable coupled to the forward section of the second limb lever and coupled to the intermediate section of the first limb lever in a location such that the second cable is intersectable with the first lever pivot axis.

2. The archery bow of claim 1, without rotary cams and without independent timing features.

3. The archery bow of claim 1, wherein the first and second limbs are split limbs and the first and second cables extend between the split first and second limbs.

4. The archery bow of claim 1, wherein the first cable is coupled to the intermediate section of the second limb lever in a location such that the first cable intersects the second lever pivot axis when the archery bow is in a state of rest, and wherein the second cable is coupled to the intermediate section of the first limb lever in a location such that the second cable intersects the first lever pivot axis when the archery bow is in a state of rest.

5. The archery bow of claim 1, wherein the first cable is coupled to the intermediate section of the second limb lever in a location such that the first cable is traversable through the second lever pivot axis, and wherein the second cable is coupled to the intermediate section of the first limb lever in a location such that the second cable is traversable through the first lever pivot axis.

6. The archery bow of claim 1, wherein the first cable is coupled to the intermediate section of the second limb lever in the location such that the first cable is traverses the second lever pivot axis as the archery bow is drawn, and wherein the second cable is coupled to the intermediate section of the first limb lever in the location such that the second cable traverses the first lever pivot axis as the archery bow is drawn.

7. The archery bow of claim 1, wherein the first cable is coupled to the intermediate section of the second limb lever in the location such that the first cable is disposed rearward of the second lever pivot axis when the archery bow is fully drawn, and wherein the second cable is coupled to the intermediate section of the first limb lever in the location such that the second cable is disposed rearward of the first lever pivot axis when the archery bow is fully drawn.

8. The archery bow of claim 1, wherein at least one of the first cable or the second cable is coupled to the respective limb lever in a central plane perpendicular to and centered across the respective pivot axis.

9. The archery bow of claim 8, wherein the second cable includes:

a second yoke pulley having a second yoke body and a second yoke roller rotatably coupled to the second yoke body;

a second yoke roller cable including a second roller cable portion coupled to the first limb lever and a second split roller cable portion coupled to the first limb; and a second yoke body cable coupled to the second yoke body and to the second limb lever.

10. The archery bow of claim 1, wherein at least one of the first cable or the second cable includes a loop rotatably anchored around a cylindrical anchor.

11. The archery bow of claim 10, wherein the cylindrical anchor includes a shaft rotatably coupled to the respective limb lever.

12. The archery bow of claim 1, wherein the first cable includes:

a first yoke pulley having a first yoke body and a first yoke roller rotatably coupled to the first yoke body;

a first yoke roller cable including a first roller cable portion coupled to the second limb lever and a first split roller cable portion coupled to the second limb; and a first yoke body cable coupled to the first yoke body and to the first limb lever.

13. An archery bow, comprising:

first and second limbs;

first and second limb levers pivotably coupled to the first and second limbs about first and second lever pivot axes and including:

forward sections on forward sides of the pivot axes, rearward sections on rearward sides of the pivot axes, and intermediate sections between the forward and rearward sections;

a bowstring coupled to the rearward sections of the limb levers;

a first cable coupled to the forward section of the first limb lever and coupled to the intermediate section of the second limb lever; and a second cable coupled to the forward section of the second limb lever and coupled to the intermediate section of the first limb lever, wherein at least one of the first cable or the second cable is coupled to the respective limb lever in a central plane perpendicular to and centered across the respective pivot axis.

14. The archery bow of claim 13, without cams and without independent timing features.

15. The archery bow of claim 13, wherein the first and second cables are coupled to the limb levers in the central plane perpendicular to and centered across the pivot axes.

16. The archery bow of claim 13, wherein the first cable is coupled to the intermediate section of the second limb lever in a location such that the first cable is intersectable with the second lever pivot axis, and wherein the second cable is coupled to the intermediate section of the first limb lever in a location such that the second cable is intersectable with the first lever pivot axis.

17. The archery bow of claim 13, wherein the first cable includes:

a first yoke pulley having a first yoke body and a first yoke roller rotatably coupled to the first yoke body;

a first yoke roller cable including a first roller cable portion coupled to the second limb lever and a first split roller cable portion coupled to the second limb; and a first yoke body cable coupled to the first yoke body and to the first limb lever.

18. The archery bow of claim 17, wherein the second cable includes:

a second yoke pulley having a second yoke body and a second yoke roller rotatably coupled to the second yoke body;

a second yoke roller cable including a second roller cable portion coupled to the first limb lever and a second split roller cable portion coupled to the first limb; and a second yoke body cable coupled to the second yoke body and to the second limb lever.

19. The archery bow of claim 13, wherein at least one of the first cable or the second cable includes a loop rotatably anchored around a cylindrical anchor.

20. The archery bow of claim 19, wherein the cylindrical anchor includes a shaft rotatably coupled to the respective limb lever.

21. An archery bow that includes:

a riser;

limbs projecting from said riser;

a first limb lever mounted on a first of said limbs for rotation around a first split axis and including a cable take-up and a cable let-out;

a second limb lever mounted on a second of said limbs for rotation around a second split axis and including a cable take-up and a cable let-out; and a bowstring cable extending from a bowstring let-out on said first and second limb levers;

a first cable extending from said cable take-up on said first limb lever to said cable let-out and/or take-up on said second limb lever; and a second cable extending from said cable take-up on said second limb lever to said cable let-out and/or take-up on said first limb lever, such that draw of said bowstring cable away from said handle lets out bowstring cable from said let-out on said first and second limb levers rotating on said first and second split axes and takes-up said first and second cables from said first and second cable let-out and/or take-up on said first and second limb levers.

22. The bow set forth in claim 21, further comprising: adjustable take-up and let-out and/or take-up anchors attached to said first and second limb levers.

23. The bow set forth in claim 21, further comprising: adjustable take-up and let-out and/or take-up eccentrics attached to said first and second limb levers.

24. The bow set forth in claim 21, wherein said bow is a crossbow.

25. A compound archery bow that includes:

a riser;

limbs projecting from said riser;

a first limb lever mounted on a first of said limbs for rotation around a first split axis and including a cable take-up and a cable let-out;

a second limb lever mounted on a second of said limbs for rotation around a second split axis and including a cable take-up and a cable let-out; and a bowstring cable extending from bowstring let-out on said first and second limb levers;

a first cable extending from said cable take-up on said first limb lever and toward said second limb lever, and connecting to a first idler pulley mounting bracket having a third axis;

a second cable extending from said cable let-out and/or said cable take-up of said second limb lever, extending around a first idler pulley, and splitting into split portions connecting to opposite sides of said second limb lever;

a third cable extending from said cable take-up on said second limb lever and toward said first limb lever, and connecting to a second idler pulley mounting bracket having a fourth axis; and a fourth cable extending from said cable let-out and/or said cable take-up of said first limb lever, extending around a second idler pulley, and splitting into split portions connecting to opposite sides of said first limb lever, such that draw of said bowstring cable away from said handle lets out bowstring cable from said cable let-out on said first and second limb levers rotating on said first and second split axes and takes-up said first and third cables from said first and second idler pulley mounting brackets with a second and fourth cable extending from said cable let-out and/or said cable take-up of said second limb lever extending around the first and second idler pulley and splitting into split portions connecting to opposite sides of said first and second limb levers.

26. The bow set forth in claim 25, further comprising: adjustable take-up and let-out and/or take-up anchors attached to said first and second limb levers.

27. The bow set forth in claim 25, further comprising: adjustable take-up and let-out and/or take-up eccentrics attached to said first and second limb levers.

28. The bow set forth in claim 25, wherein said bow is a crossbow.

* * * * *